US008083558B2

(12) United States Patent
Inaba

(10) Patent No.: US 8,083,558 B2
(45) Date of Patent: Dec. 27, 2011

(54) OUTBOARD MOTOR

(75) Inventor: Takeshi Inaba, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 225 days.

(21) Appl. No.: 12/607,601

(22) Filed: Oct. 28, 2009

(65) Prior Publication Data

US 2010/0255737 A1 Oct. 7, 2010

(30) Foreign Application Priority Data

Dec. 11, 2008 (JP) ..... 2008-316033

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS

| | | | | |
|---|---|---|---|---|
| 3,610,198 | A | 10/1971 | Alexandrowicz et al. | |
| 5,340,343 | A | 8/1994 | Kawamukai et al. | |
| 6,821,170 | B2 * | 11/2004 | Sanschagrin et al. | 440/77 |
| 7,118,432 | B2 * | 10/2006 | Katayama | 440/77 |
| 7,238,069 | B2 | 7/2007 | Ito et al. | |
| 7,267,591 | B2 * | 9/2007 | Kimura et al. | 440/77 |
| 7,425,163 | B2 * | 9/2008 | Murai et al. | 440/77 |
| 2006/0116035 | A1 | 6/2006 | Ito et al. | |

FOREIGN PATENT DOCUMENTS

| | | | |
|---|---|---|---|
| JP | 5-286490 | A | 11/1993 |
| JP | 2000-016389 | A | 1/2000 |
| JP | 2004-299485 | A | 10/2004 |
| JP | 2006-151242 | A | 6/2006 |
| JP | 2006-347335 | A | 12/2006 |

OTHER PUBLICATIONS

Japanese Office Action dated May 24, 2011, issued in corresponding Japanese Patent Application 2008-316033.

* cited by examiner

*Primary Examiner* — Stephen Avila
(74) *Attorney, Agent, or Firm* — Westerman, Hattori, Daniels & Adrian, LLP

(57) ABSTRACT

An outboard motor has a top cover extending over an engine cover covering an engine, and an upstream intake silencer spaced upward apart from the top wall of the engine cover. The upstream intake silencer has an entrance duct spaced apart from the top wall and forming an inlet air passage through which air for combustion flows from an air-intake space into the upstream intake silencer. The upstream end of the inlet air passage is on the rear side of the downstream end of an outlet air passage and at a level above that of an air-intake opening. The entrance duct does not extend downward from a bottom wall forming the upstream expansion chamber and protrudes upward from the bottom wall in the upstream expansion chamber.

5 Claims, 4 Drawing Sheets

OUTBOARD MOTOR

BACKGROUND OF THE INVENTION

1. Field of the Invention

The present invention relates to an outboard motor including an internal combustion engine provided with an intake system for carrying air for combustion, namely, intake air, into a combustion chamber, an engine cover forming an engine compartment in which the internal combustion engine is placed, a top cover covering the engine cover from above, and an intake silencer.

2. Description of the Related Art

A known outboard motor disclosed in, for example JP 5-286490 A, JP 2006-151242 and U.S. Pat. No. 3,610,198 includes an internal combustion engine provided with an intake system for carrying intake air for combustion into a combustion chamber, an engine cover forming an engine compartment in which the internal combustion engine is placed, a top cover covering the engine cover from above. In this outboard motor, intake air taken into an air-intake space defined by the engine cover and the top cover is carried into the intake system disposed in the engine compartment.

When the intake system disposed within the engine compartment of the outboard motor opens into the air-intake space outside the engine compartment, cool intake air can be taken into the intake system, as compared with a case in which intake air is taken into the engine compartment and warmed by heat radiated from the engine in the engine compartment. Thus, the internal combustion engine can be charged at an improved charging efficiency and the output performance of the engine can be improved when such intake air at lowered temperature is taken into the intake system.

When the intake system opens into the air-intake space outside the engine compartment, the intake pulsation caused by the internal combustion engine is transmitted through the intake system to the air-intake space. Since the air-intake space is defined by the top cover and the engine cover, the engine cover is vibrated by the intake pulsation transmitted to the air-intake space to generate noise.

When an air-intake passage connecting an air-intake opening into the air-intake space to the intake system is formed in a labyrinthine shape to prevent water collected in the air-intake space from flowing into the intake system, intake resistance increases to deteriorate the output performance of the internal combustion engine.

SUMMARY OF THE INVENTION

The present invention has been made in view of such problems and it is therefore a principal object of the present invention to reduce noise generated by the engine cover which is vibrated by intake pulsation transmitted to the air-intake space through the intake system in the engine compartment formed by the engine cover, to increase the degree of freedom of designing the engine cover forming the air-intake space, and to form the outboard motor in small vertical dimensions by disposing the intake silencer close to the engine cover.

Another object of the present invention is to restrain water from mixing into the intake air and to improve the output performance of the internal combustion engine by properly arranging the inlet, the outlet and the throttle passage of the intake silencer.

To attain the objects, the present invention provides an outboard motor comprising: an internal combustion engine; an intake system for carrying intake air for combustion into a combustion chamber formed in the internal combustion engine; an engine cover forming an engine compartment for enclosing the internal combustion engine; and a top cover covering the engine cover from above:

wherein the outboard motor includes an air-intake opening formed outside the engine compartment, and an intake silencer for carrying intake air taken in through the air-intake opening into the intake system, the intake system being disposed within the engine compartment;

wherein the intake silencer is disposed outside the engine compartment, is spaced apart from the engine cover such that an air-intake space connecting to the air-intake opening is formed between a top wall of the engine cover and the intake silencer; and the intake silencer has an entrance duct spaced apart from the top wall and having an upstream end through which intake air flows from the air-intake space into the entrance duct, a wall structure defining an expansion chamber into which intake air flows through the inlet air passage, and an exit duct forming an outlet air passage through which intake air flows from the expansion chamber into the intake system; and wherein the inlet air passage has an upstream end opening into the air-intake space, and is on a rear side of a downstream end of the outlet air passage and at a level higher than that of the air-intake opening; and the entrance duct does not extend downward from a bottom wall included in the wall structure defining the expansion chamber and extends upward from the bottom wall in the expansion chamber.

In the outboard motor of the present invention, the pulsation of intake air in the intake system disposed in the engine compartment is attenuated by the upstream intake silencer disposed outside the engine compartment, and the upstream intake silencer is spaced apart from the engine cover by the air-intake space. Therefore, the pulsation of intake air transmitted from the intake system to the air-intake space is suppressed and hence noise resulting from the vibration of the engine cover defining the air-intake space is reduced.

The inlet air passage of the upstream intake silencer opening into the air-intake space is on a rear side of the outlet air passage and hence the inlet air passage is apart from the engine operator in front of the outboard motor. Therefore, the level of intake noise leaking through the inlet air passage is attenuated before the intake noise reaches the engine operator.

The inlet air passage is at a level higher than that of the air-intake opening and the entrance duct is spaced apart from the engine cover. Therefore, restrictions placed by the entrance duct on designing the shape of the top wall of the engine cover defining the air-intake space so as to ensure satisfactory draining of water from the air-intake space are reduced and hence the degree of freedom of designing the top wall increases. Since the entrance duct extends upward in the upstream expansion chamber, the intake silencer can be disposed close to the engine cover with respect to the vertical direction and hence the vertical dimension of the outboard motor can be reduced.

In a preferred mode of the present invention, the intake system is provided with a downstream intake silencer into which intake air flows through the outlet air passage, the downstream intake silencer has a downstream expansion chamber, a vertically extending inlet air passage opening into an upper part of the downstream expansion chamber, and a horizontally extending outlet air passage formed above a bottom wall forming the downstream expansion chamber, the downstream expansion chamber has a lower extension extending to a level below that of the outlet air passage, and a horizontal water-stopping rib is disposed between the lower extension and the outlet air passage.

Since the downstream expansion chamber has the lower extension extending to a level below that of the horizontal outlet air passage, water flowing into the downstream expansion chamber together with intake air flowing vertically downward into the downstream expansion chamber flows by inertia toward the lower extension and adheres to the bottom wall, and the downstream expansion chamber is provided with the water-stopping rib, water is restrained from flowing into the outlet air passage.

In another preferred mode of the present invention, the intake system is provided with a throttle valve device forming a throttle passage connecting to the outlet air passage, and the inlet air passage, the outlet air passage and the outlet air passage are extended so as to intersect a straight line intersecting the inlet air passage and the throttle passage in a plane.

Thus, the flow of intake air through the inlet air passage, the outlet air passage and the inlet air passage into the throttle passage, i.e., the flow of intake air through the upstream and downstream intake silencers, is restrained from horizontal meandering and intake air flows smoothly without meandering horizontally. Consequently, intake resistance is low, and the volumetric efficiency and output performance of the internal combustion engine are improved.

Preferably, the air-intake opening opens rearward at the rear end of the air-intake space, and a rib is formed on the top wall so as to protrude upward from the top wall in the air-intake space and to extend on right, left and rear sides of the upstream end of the inlet air passage.

The rib protruding upward from the top wall of the engine cover and extending on the rear side of the upstream end of the inlet air passage prevents water leaking into the air-intake space from flowing into the inlet air passage. Thus, water is restrained from entering the upstream intake silencer.

The air-intake opening may extend on right, left and rear sides of the upstream intake silencer.

Since the air-intake opening thus extends on the right, left and rear sides of the upstream intake silencer, the air-intake opening has a long circumference. Therefore, the air-intake opening can be formed in a small width while the air-intake opening ensures taking external air in at a necessary intake rate, and the effect of the air-intake opening on suppressing the entrance of water and foreign maters into the air-intake space can be ensured. Since water that has entered the air-intake space is drained laterally from the air-intake space, water is prevented from entering through the air-intake opening into the upstream intake silencer.

DESCRIPTION OF THE PREFERRED EMBODIMENTS

An outboard motor S in a preferred embodiment of the present invention will be described with reference to FIGS. 1 to 4.

Figure 1:
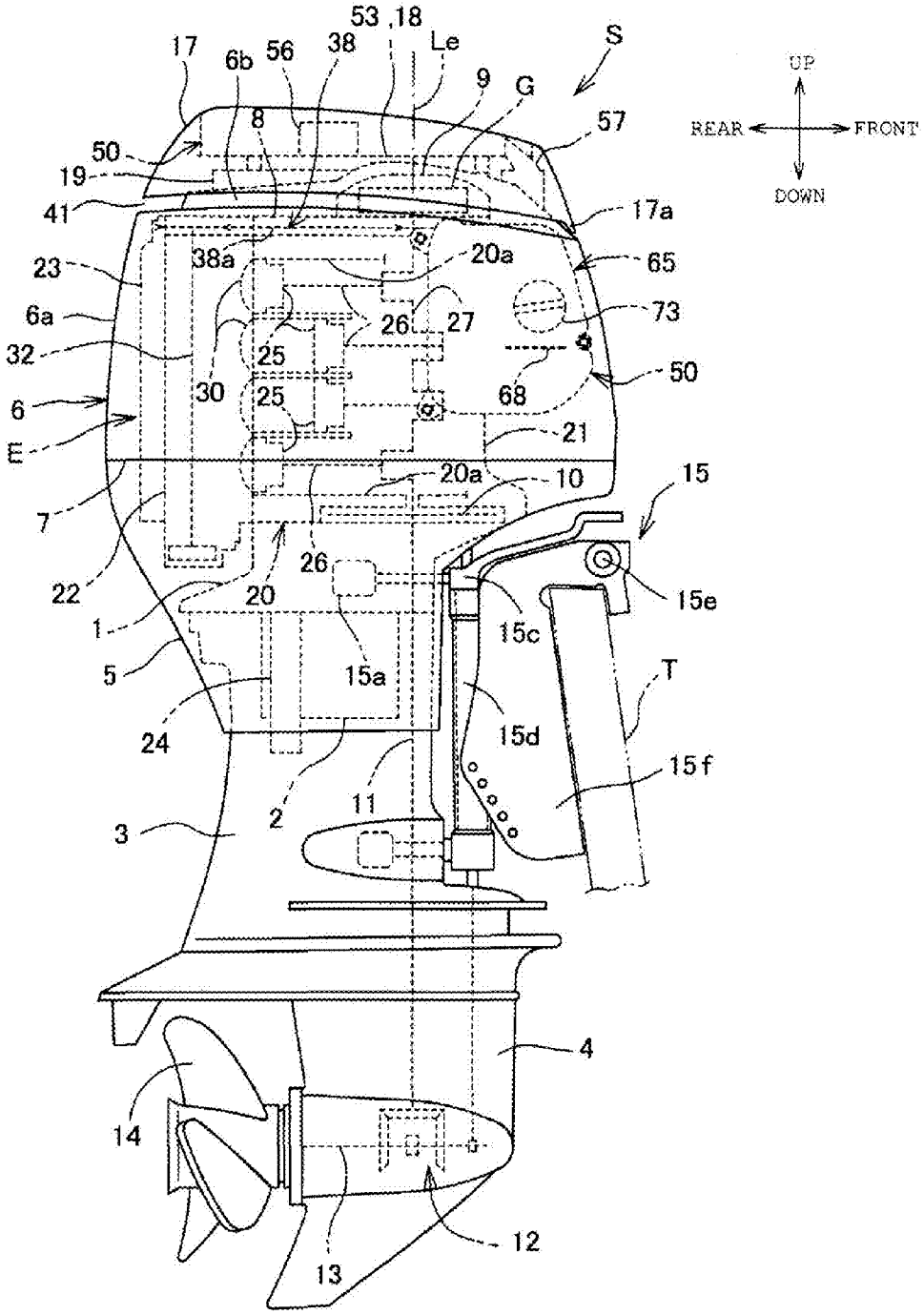
FIG. 1 is a side elevation of an outboard motor in a preferred embodiment of the present invention taken from the right side of the outboard motor.

Referring to FIG. 1, the outboard motor S to which the invention is applied includes an internal combustion engine E provided with a vertical crankshaft 27 having a vertical center axis Le, namely a vertical combustion engine, an engine mount 1 supporting the internal combustion engine E, an extension case 3 surrounding an oil pan 2 joined to the lower end of the engine mount 1 and joined to the lower end of the engine mount 1, a gear case 4 joined to the lower end of the extension case 3, an under cover 5 covering a part of the outboard motor S between a lower part of the engine E and the upper end of the extension case 3, and an engine cover 6 joined to the upper end of the under cover 5 and covering the internal combustion engine E from above. The engine cover 6 has a side wall 6*a* disposed around the center axis Le, and a top wall 6*b* extending over the internal combustion engine E. The internal combustion engine E is held in an engine compartment 7 defined by the under cover 5 and the engine cover 6.

In the specification and claims, directions designated by vertical directions, longitudinal directions and lateral directions correspond to vertical directions, longitudinal directions and lateral directions with respect to the hull T of the boat. As shown in FIG. 1, a direction parallel to the center axis Le of the crankshaft 27 is the vertical direction, and the longitudinal directions and the lateral directions are in a horizontal plane perpendicular to the center axis Le. Upward and downward directions are parallel to the vertical center axis Le, forward and rearward directions are parallel to one of the longitudinal directions and the other longitudinal direction, respectively. Rightward and leftward directions are one of the lateral directions and the other lateral direction, respectively. Viewing in a plane means viewing from a vertical direction or a direction parallel to the center axis Le. A circumferential direction is parallel to a circumference about the center axis Le unless otherwise specified.

A transmission included in the outboard motor S includes a drive shaft 11 connected to the lower end of the crankshaft 27, namely, an output shaft, a flywheel 10 fixedly mounted on the drive shaft 11, a forward-rearward change gear 12 contained in the gear case 4, and a propeller shaft 13 holding a propeller 14. The output power of the internal combustion engine E is transmitted from the crankshaft 27 through the drive shaft 11, the forward-rearward change gear 12 and the propeller shaft 13 to the propeller 14 to rotate the propeller 14. In this embodiment, the center axis of the drive shaft 11 is aligned with the center axis Le. The center axis of the drive shaft 11 may be parallel to the center axis Le.

A mounting device 15 for holding the outboard motor S on the hull T includes a swivel case 15*d* fixedly held by mounting rubber cushions 15*a* on the mount 1 and the extension case 3, a swivel shaft 15*c* rotatably supported on the swivel case 15*d*, a tilt shaft 15*e* supporting the swivel case 15*d* so as to be turnable thereon, and a transom clamp 15*f* holding the tilt shaft 15*e* and fixed to the transom of the hull T. The outboard motor S supported on the hull T by the mounting device 15 is turnable on the tilt shaft 15*e* in a vertical plane and can turn on the swivel shaft 15*c* in a horizontal plane.

Figure 2:
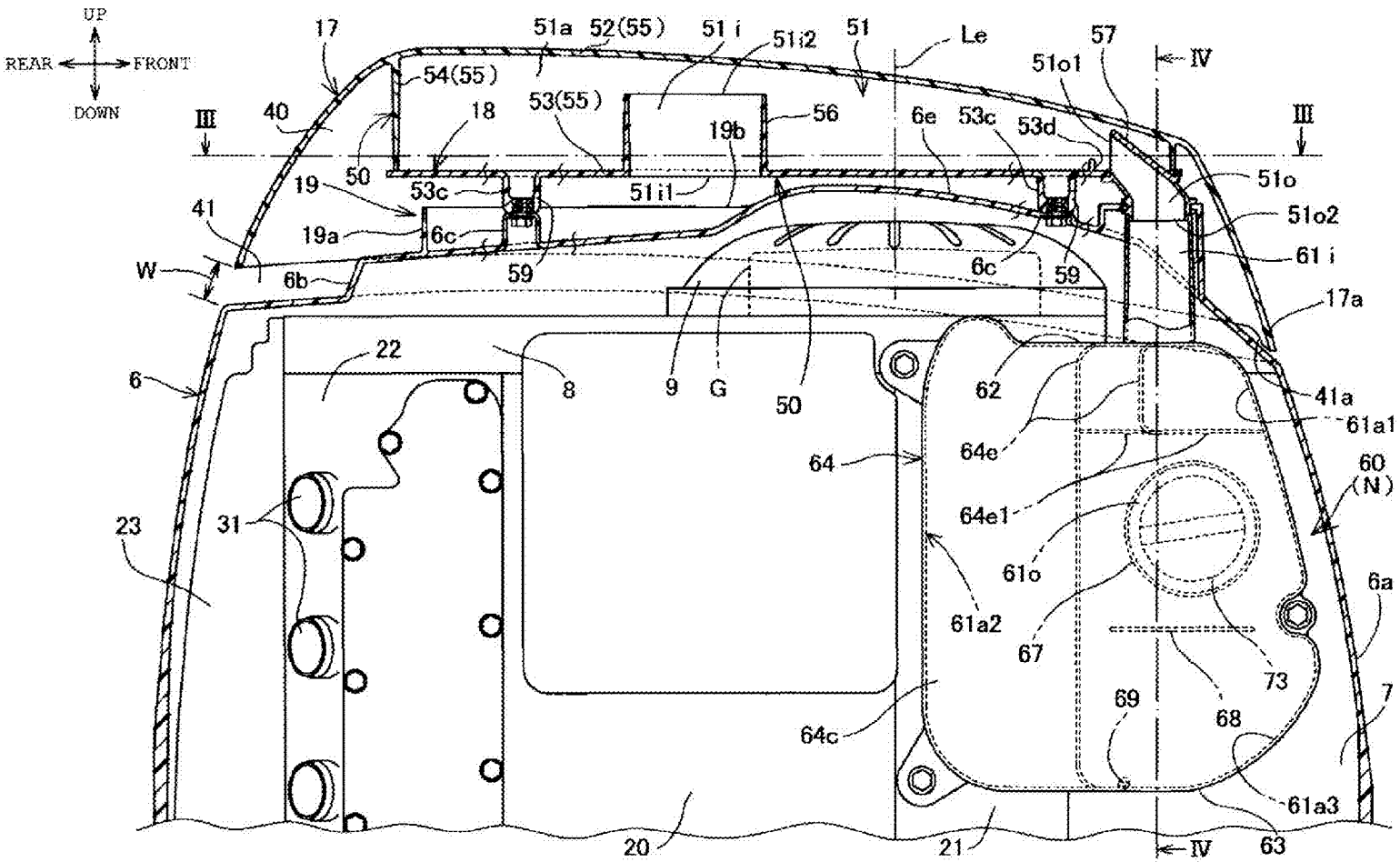
FIG. 2 is a side view, in vertical section, of an engine cover, a top cover and an intake silencer included in the outboard motor shown in FIG. 1, in which part of an internal combustion engine as viewed from the right is shown.

Referring to FIG. 2, the internal combustion engine E is a multiple-cylinder four-stroke-cycle internal combustion engine and has an engine body including a cylinder block 20 provided with four cylinders 20*a* (FIG. 1) vertically arranged in a row, a crankcase 21 joined to the front end of the cylinder block 20, a cylinder head 22 joined to the rear end of the cylinder block 20, and a valve cover 23 joined to the rear end of the cylinder head 22.

The cylinder head 22 and the valve cover 23 are rear members of the engine body. The crankcase 21 is a front member of the engine body, disposed on the front side of the center axis Le of the crankshaft 27.

As shown in FIG. 11, pistons 25 are fitted in the cylinders 20*a*, respectively, so as to be axially movable and connected by connecting rods 26 to the crankshaft 27 rotatably supported on the cylinder block 20 and the crankcase 21, respectively. The cylinder head 22 is provided with combustion chambers 30 and bores 31 (FIG. 2) for receiving spark plugs. The combustion chambers 30 are axially opposite to the pistons 25, respectively. The spark plugs fitted in the bores 31 are exposed to the combustion chambers 30, respectively.

Intake valves and exhaust valves are provided respectively for closing and opening intake ports and exhaust ports formed in the cylinder head 22 and open into the combustion chambers 30. The intake valves and exhaust valves are driven for opening and closing operations in synchronism with the rotation of the crankshaft 27 by a camshaft 32 included in an overhead camshaft type valve train disposed in a valve chamber formed by the cylinder head 22 and the valve cover 23. The camshaft 32 is covered with a transmission case 8 (FIG. 2) from above. The camshaft 32 is rotationally driven by the power of the crankshaft 27 through a wrapping transmission mechanism 38 including a belt 38*a*.

A generator cover 9 covering an alternator G is connected to the transmission case 8. The alternator G is rotationally driven by the crankshaft 27.

Figure 3:
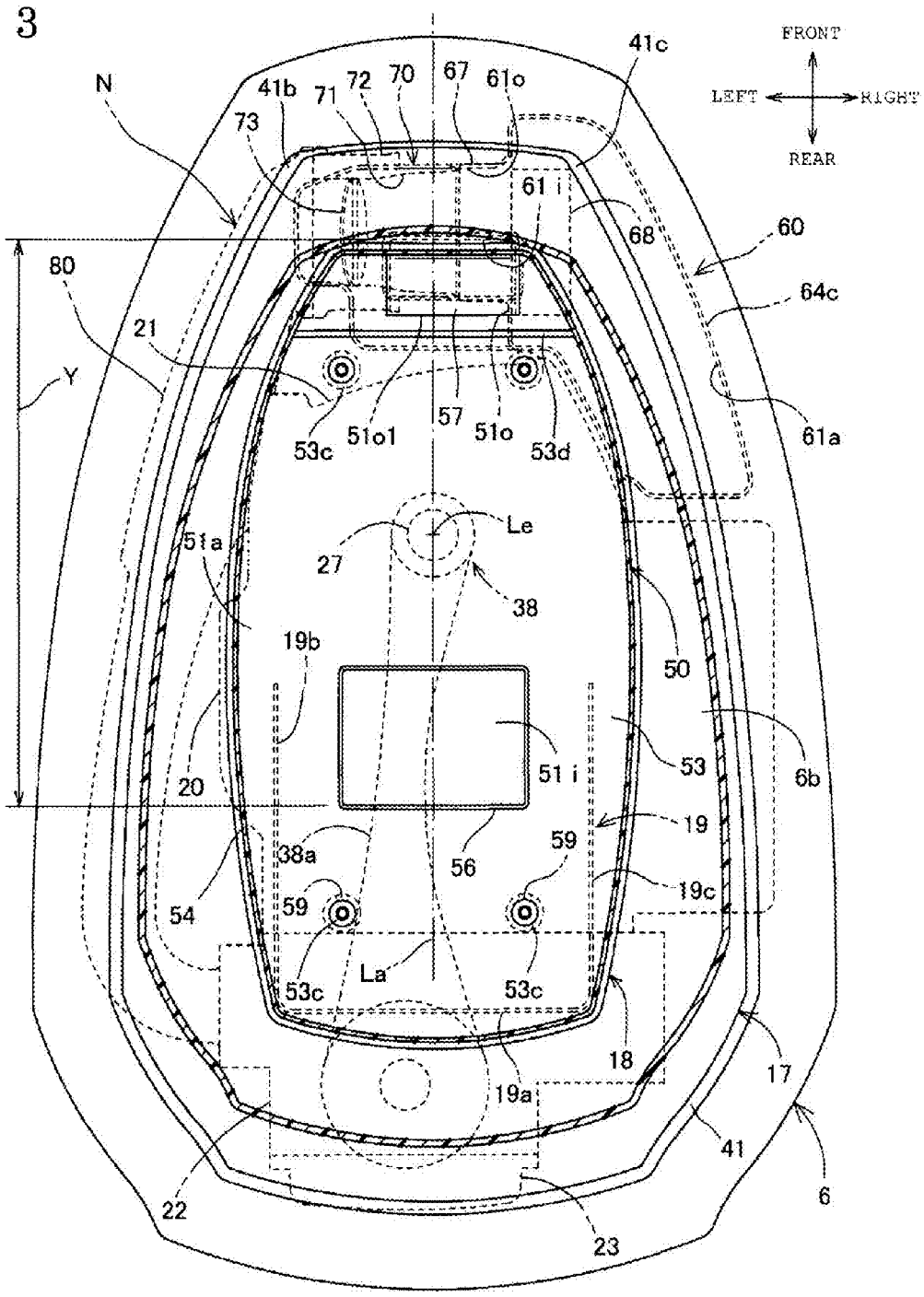
FIG. 3 is a sectional plan view taken on the line III-III in FIG. 2.

Referring to FIGS. 2 and 3, the internal combustion engine E is provided with an intake system N disposed within the engine compartment 7. The intake system N forms an air-intake passage for carrying intake air for combustion taken therein through an air-intake opening to the combustion chambers 30. Intake air flowing in the air-intake passage is mixed with fuel ejected by a fuel injection valve to form an air-fuel mixture. The air-fuel mixture is ignited by the spark plug and burns in the combustion chamber 30. The piston 25 is driven for reciprocation by the pressure of combustion gas produced in the combustion chamber 30. The piston 25 thus driven rotationally drives the crankshaft 27 through the connecting rod 26. The combustion gas that has worked for driving the piston 25 is discharged as an exhaust gas into an exhaust pipe 24 (FIG. 1). The exhaust gas flows from the exhaust pipe 24 into an exhaust passage, not shown, formed in the extension case 12, the gear case 13 and the boss of the propeller 20 and is discharged from the outboard motor S.

Referring to FIG. 1, the outboard motor S has an upstream intake silencer 50, namely, an air intake device, and a top cover 17. The intake silencer 50 is disposed at a position directly above the engine compartment 7 or the top wall 6*b* of the engine cover 6 outside the engine compartment 7. The top cover 17 covers the top wall 6*b* of the engine cover 6 from above. As shown in FIG. 2, the upstream intake silencer 50 forms an air-intake passage 51. Air for combustion flows through the upstream intake silencer 50 into the intake system N.

A space extending under the top cover 17 and the upstream intake silencer 50 and over the top wall 6*b* is an air-intake space 40 through which air for combustion flows into the air-intake passage 51. Joining parts 6*c* formed on the top wall 6*b* and joining parts 53*c* formed on the upstream intake silencer 50 so as to correspond to the joining parts 6*c*, respectively, are fastened together with bolts. Parts of the upstream intake silencer 50 other than the joining parts 53*c* are spaced upwardly apart from the top cover 6*b* of the engine cover 6 so as to form the air-intake space 40.

An air-intake opening 41 extends circumferentially along the engine cover 6 and the top cover 17. The air-intake opening 41 opens into the air-intake space 40. The air-intake opening 41 has a width W corresponding to the distance between the boundary between the side wall 6*a* and the top wall 6*b*, and the lower edge of the top cover 17. A front part 41*a* of the air-intake opening 41 is covered with a covering part 17*a* formed by extending a front part of the top cover 17 downward. The front part 41*a* of the air-intake opening 41 is a small gap or is closed. The front part 17*a* of the top cover 17 prevents entrance of water coming from the front side of the outboard motor S through the air-intake opening 41 into the air-intake space 40.

Figure 4:
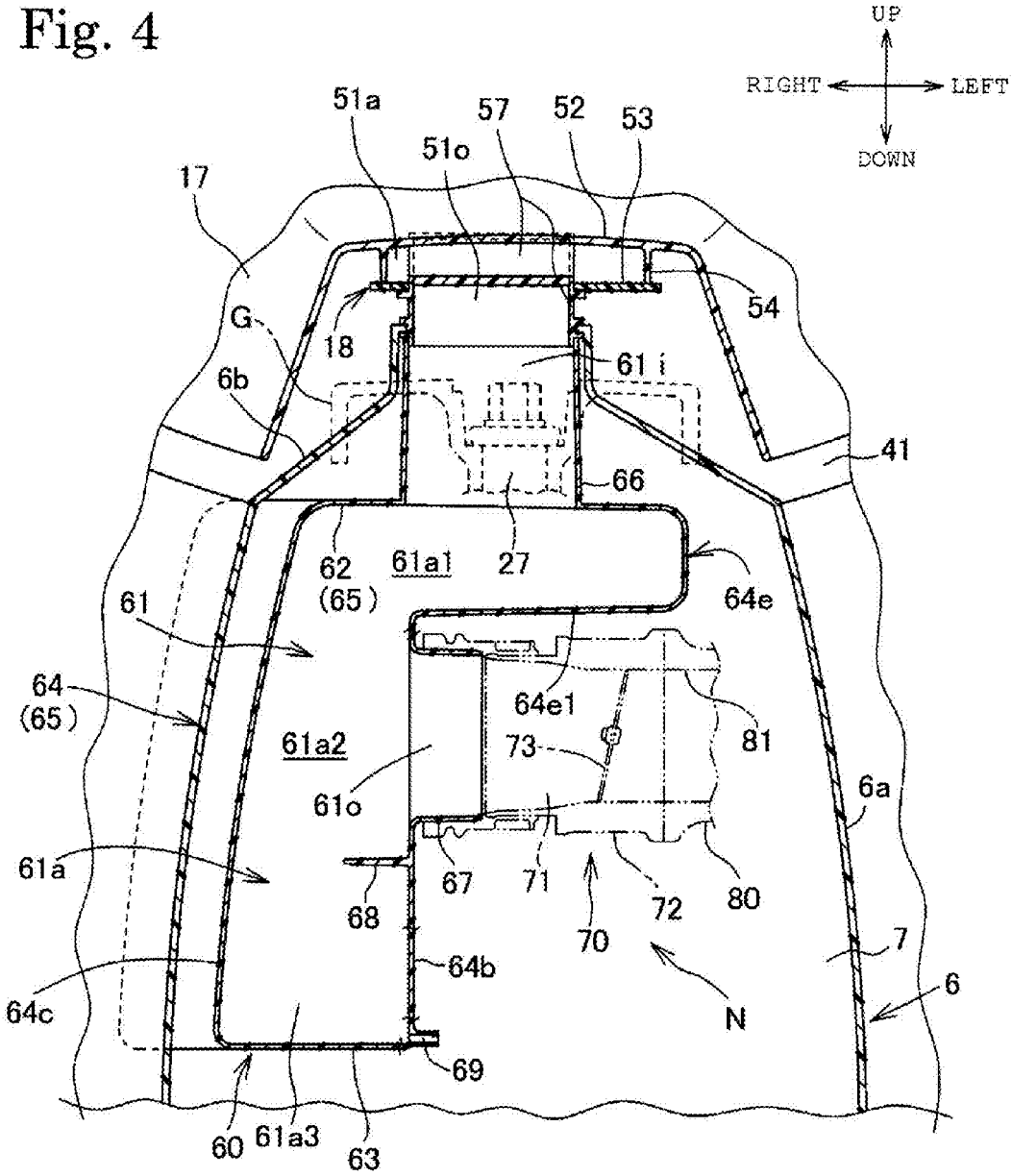
FIG. 4 is a sectional view of an essential part of the outboard motor sown in FIG. 1 taken on the line IV-IV in FIG. 2.

Referring to FIGS. 2 and 4, the upstream intake silencer 50 disposed outside the engine compartment 7 and forming the air-intake passage 51 has a top wall 52, which is a part of the top cover 17, a bottom wall 53 serving as an intermediate cover 18 disposed between the top wall 6*b* and the top cover 17 with respect to the vertical direction, a vertical side walls 54 formed integrally with the top cover 17 and extending between the top wall 52 and the bottom wall 32, an entrance duct 56 formed integrally with the intermediate cover 18, namely, the bottom wall 53, and an exit duct 57 joined to the intermediate cover 18, namely, the bottom wall 53. The bottom wall 53 vertically spaced apart from the top wall 6*b* so as to define the air-intake space 40. The entrance duct 56 is separated upward from the top wall 6*b*.

The air-intake passage 51, through which air for combustion flows into the air intake system N, has an upstream expansion chamber 51*a*, namely, an inlet air silencing chamber, defined by a wall structure 55 formed of the top wall 52, the bottom wall 53 and the side walls 54, an inlet air passage 51*i*, defined by the entrance duct 56, and an outlet air passage 51*o* defined by the exit duct 57. Air flows from the air-intake space 40 through the inlet air passage 51*i* into the upstream expansion chamber 51*a*. Air flows from the upstream expansion chamber 51*a* through the outlet air passage 51*o* into a downstream intake silencer 60. The sectional area of the upstream expansion chamber 51*a* into which air flows through the inlet air passage 51*i* is greater than the respective passage areas of the inlet air passage 51*i* and the outlet air passage 51*o*.

The inlet air passage 51*i* extending upward into the upstream expansion chamber 51*a* has an upstream end 51*i*1 opening into the air-intake space 40, and a downstream end 51*i*2 opening into the upstream expansion chamber 51*a*. The outlet air passage 51*o* has an upstream end 51*o*1 opening into the upstream expansion chamber 51*a*, and a downstream end 51*o*2 opening into an entrance duct 66 (FIG. 4).

The entrance duct 56 does not protrude downward from the bottom wall 53 and protrudes upward from the bottom wall 53 into the upstream expansion chamber 51*a*. The exit duct 57 protrudes from the bottom wall 53 into the upstream expansion chamber 51*a*. A downstream part of the exit duct 57 is connected to the entrance duct 66 included in the downstream intake silencer 60. The exit duct 57 deflects horizontal air flow in the upstream expansion chamber 51*a* into vertical flow of air into the entrance duct 66.

The upstream end 51*i*1 of the inlet air passage 51*i* opens downward into the air-intake space 40. The upstream end 51*o*1 of the outlet air passage 51*o* opens rearward so as to face the entrance duct 56. The inlet air passage 51*i* and the outlet air passage 51*o* are spaced apart from each other with respect to the longitudinal direction and are disposed on the opposite sides, respectively, with respect to the center axis Le. The inlet air passage 51*i* including the upstream end 51*i*1 are disposed on the rear side of the outlet air passage 51*o* including the downstream end 51*o*2. The positional relation between the inlet air passage 51*i* and the outlet air passage 51*o* in a plane is shown in FIG. 3.

As shown in FIGS. 2 and 3, a water-stopping rib 53*d* is formed near the upstream end 51*o*1 of the outlet air passage 51*o* and on the rear side of the upstream end 51*o*1 of the outlet air passage 51*o*. The water-stopping rib 53*d* rises from the bottom wall 53. The water-stopping wall 53*d* prevents water collected on the bottom wall 53*d* from flowing through the upstream end 51*o*1 into the exit duct 57.

The air-intake opening 41 is at a level lower than those of the upstream intake silencer 50 having the upstream expansion chamber 51*a* and the upstream end 51*i*1 of the inlet air passage 51*i*. The U-shaped air-intake opening 41 surrounds the rear, right and left sides of the upstream intake silencer 50 or the upstream expansion chamber 51*a* as viewed in a plane as shown in FIG. 3. Thus, the air-intake opening 41 opens rearward in a rear end part of the air-intake space 40.

The front ends 41*b* and 41*c* of the U-shaped air-intake opening 41 are on the front side of the outlet air passage 51*o*, the center axis Le, the inlet air passage 51*i* and the upstream intake silencer 50 having the upstream expansion chamber 51*a* with respect to the longitudinal direction. Therefore, as obvious from FIG. 3, the air-intake opening 41 extends longitudinally on the right and left sides of the upstream end 51*i*1 of the inlet air passage 51*i* and the downstream end 51*o*2 of the outlet air passage 51*o* beyond the front and rear ends of a range Y in which the upstream end 51*i*1 and the downstream end 51*o*2 are arranged. Thus, the air-intake opening 41 extends on the right and left sides of the upstream end 51*i*1 with respect to the lateral direction, and extends longitudinally from a position corresponding to the cylinder head 22 and the valve cover 23 to a position on the front side of the center axis Le of the crankshaft 27 of the internal combustion engine E.

Therefore, the circumferential length of the air-intake opening 41 surrounding the air-intake space 40 is prolonged and hence air for combustion can be taken in at a necessary intake rate and the width W of the air-intake opening 41 may be small.

Referring to FIGS. 2 to 4, the intake system N forming the air-intake passage for carrying intake air for combustion taken therein through the air-intake opening 41 to the combustion chambers 30 includes the downstream intake silencer 60. The downstream intake silencer 60 extends to the right from a position on the front side of the crankcase 21 in the engine compartment. The intake system N further includes a throttle device 70 disposed on the front side of the crankcase 21 connected to the downstream end of the downstream intake silencer 60 and is provided with a throttle valve 73 controlling air flow and an intake manifold 80 having an upstream end connected to the downstream end of the throttle device 70 and a downstream end connected to the cylinder head 22 provided with the intake ports.

The air-intake passage continuously extending from an inlet air passage 61*i* to the intake ports has an upstream intake passage 61, a throttle passage 71 provided with the throttle valve 73 and defined by a throttle body 72 included in the throttle device 70, and a downstream intake passage 81 defined by the intake manifold 80 and connected by the throttle passage 71 to the upstream intake passage 61. Air flows from the downstream intake passage 81 through the exit of the air-intake passage into the intake ports. Air is sucked through the intake ports into the combustion chambers 30.

The downstream intake silencer 60 disposed on the downstream side of the upstream intake silencer 50 has a wall structure 65 forming a downstream expansion chamber 61*a*, the entrance duct 66 forming the inlet air passage 61*i*, and an exit duct 67 forming an outlet air passage 61*o*. The wall structure 65 has a top wall 62 connected to the entrance duct 66, a bottom wall 63 below the exit duct 67 and the throttle device 70, and a side wall 64 extending between the top wall 62 and the bottom wall 63. The side wall 64 has a right part 64*c* and a left part 64*b* laterally opposite to the right wall 64*c*. The exit duct 67 projects to the left from the left part 64*b*.

The upstream intake passage 61 has the downstream expansion chamber 61*a*, namely, an enlarged chamber serving as an inlet air silencing chamber, the inlet air passage 61*i* through which air flowing from the air-intake space 40 through the air-intake passage 51 flows into the expansion chamber 61*a*, and the outlet air passage 61*o* through which air flows from the expansion chamber 61*a* into the throttle passage 71. The sectional area of the downstream expansion chamber 61*a*, into which air for combustion flows from the upstream intake silencer 50 through the inlet air passage 61*i*, is greater than the respective sectional areas of the inlet air passage 61*i* and the outlet air passage 61*o*. The inlet air passage 61*i* does not open into the engine compartment 7 and communicates with the air-intake space 40.

The downstream expansion chamber 61*a* has an upper space 61*a*1 extending over the throttle device 70, and a main space 61*a*2 extending downward from the upper space 61*a*1. The upper space 61*a*1 is defined by the top wall 62 and an upper part of the side wall 64. The upper space 61*a*1 is defined mainly by the top wall 62, and a projecting part 64*e* of the left part 64*b* of the side wall 64. The projecting part 64*e* extends to the right over the throttle body 71. Thus, the top wall 62, the upper space 61*a*1, a bottom wall 64*e*1 defining the bottom of the upper space 64*a*1 overlie the throttle device 70. The bottom wall 64*e*1 is disposed immediately under the inlet air passage 61*i*. The bottom wall 64*e*1 and the inlet air passage 61*i* are superposed in a plane. The upper space 61*a* augments the volume of the downstream expansion chamber 61*a*. The downstream expansion chamber 61*a* having a large volume has a high silencing effect.

The main space 61*a*2 extending downward from the upper space 61*a*1 has a lower extension 61*a*3 extending downward below the level of the throttle device 70. The outlet air passage 61*o* opens into the main space 61*a*2 at a position below the upper space 61*a*1.

The entrance duct 66 and the inlet air passage 61*i* extend vertically. The exit duct 67 and the outlet air passage 61*o* extend horizontally. The inlet air passage 61*i* opens into the upper space 61*a*1 of the downstream expansion chamber 61*a*. The outlet air passage 61*o* is above the level of the bottom wall 63 of the downstream expansion chamber 61*a*.

As shown in FIGS. 2 and 3, a U-shaped water-stopping rib 19 rises from the top wall 6*b* into the air-intake space 40. The water-stopping rib 19 extends on the right, left and rear sides of the upstream end 51*i*1 of the inlet air passage 51*i*. The water-stopping rib 19 has a rear part 19*a* on the rear side of the upstream end 51*i*1, a right part 19*c* extending from the right end of the rear part 19*a* on the right side of the upstream end 51*i*1, and a left part 19*b* extending from the left end of the rear part 19*a* on the left side of the upstream end 51*i*1. A part of the top wall 6*b* on the front side of the upstream end 51*i*1 is bulged to form a bulged part 6*e* (FIG. 2) over the generator cover 9. As viewed in a plane, the upstream end 51*i*1 is surrounded by the bulged part 6*e* extending on the front side of the upstream end 51*i*1 and the water-stopping rib 19 extending on the right, left and rear sides of the upstream end 51*i*1.

The water-stopping rib 19 is provided with a drain hole, not shown, and the joining parts 53*c* defining cavities opening into the upstream expansion chamber 51*a* are provided with drain holes 59, respectively.

Referring to FIG. 4, the left part 64*b* of the side wall 64 is provided with a flat water-separating rib 68. The water-separating rib 68 projects from a position on the inside surface of the left part 64*b* between the lower extension 61*a*3 and the outlet air passage 61*o*. The water-separating rib 68 extends forward and rearward beyond the outlet air passage 61*o* and the throttle passage 71. A drain hole 69 is formed in or near the bottom wall 63.

The inlet air passage 51*i* is on the opposite side of the intake air exit, the inlet air passage 61*i* and the outlet air passage 61*o* with respect to the center axis Le. The inlet air passage 51*i*, outlet air passage 51*o* and the outlet air passage 61*o* are disposed so as to intersect a straight line La (FIG. 3) intersecting the inlet air passage 51*i* and the throttle passage 71 as viewed in a plane. The straight line La crosses the center axis Le and is parallel to the longitudinal direction as viewed in a plane.

Description will be made of the operation and effect of the outboard motor S of the present invention including the internal combustion engine E provided with the intake system N for carrying air for combustion into the combustion chambers formed in the engine body, the engine cover 6 forming the engine compartment 7 for holding the internal combustion engine E, and a top cover 17 covering the engine cover 6 from above. Intake air for combustion is taken in through the air-intake opening 41 formed outside the engine compartment 7. The upstream intake silencer 50 carries the intake air into the intake system N disposed in the engine compartment 7. The upstream intake silencer 50 is formed outside the engine compartment 7 and is spaced apart from the engine cover 6 so as to form the air-intake space 40 including the air-intake opening 40 over the top wall 6*b* of the engine cover 6. The upstream intake silencer 50 has the entrance duct 56 forming the inlet air passage 51*i* and separated from the top wall 6*b*, the wall structure 55 forming the upstream expansion chamber 51*a* into which the intake air flows through the inlet air passage 51*i*, and the exit duct 57 forming the outlet air passage 51*o* through which the intake air flows. The upstream end 51*i*1 of the inlet air passage 51*i* opens into the air-intake space 40 and is disposed on the rear side of the downstream end 51*o*2 of the outlet air passage 51*o* at the level higher than the air-intake opening 41. The entrance duct 56 does not project downward from the bottom wall 53 of the wall structure 55 and projects upward from the bottom wall 53 into the upstream expansion chamber 51*a*.

Pulsation of the intake air in the intake system N disposed in the engine compartment 7 is attenuated by the upstream intake silencer 50, and the upstream intake silencer 50 is separated upwardly from the engine cover 6 by the air-intake space 40. Therefore, transmission of the pulsation of the intake air from the intake system N to the air-intake space 40 is suppressed and hence intake noise generated by the vibration of the engine cover 6 underlying the air-intake space 40 can be reduced.

The upstream end 51*i*1 of the inlet air passage 51*i* of the upstream intake silencer 50 opening into the air-intake space 40 is on the rear side of the downstream end 51*o*2 of the exit duct 57, and hence the engine operator in front of the outboard motor is remote from the upstream end 51*i*1 of the inlet air passage 51*i*. Therefore, intake noise that leaks through the upstream end 51*i*1 of the entrance duct 56 is attenuated before reaching the engine operator.

The upstream end 51*i*1 of the inlet air passage 51*i* is at the level higher than that of the air-intake opening 41, and the entrance duct 56 is spaced apart from the top wall 6*b*. Therefore, restriction is reduced on the shape of the top wall 6*b* of the engine cover underlying the air-intake space 40 placed by the entrance duct 56 to ensure satisfactory draining from the air-intake space 40, and the degree of freedom of designing the top wall 6*b* increases. Since the entrance duct 56 projects upward into the upstream expansion chamber 51*a*, the upstream intake silencer 50 can be disposed close to the engine cover 6 with respect to the vertical direction and hence the outboard motor S can be formed in small vertical dimension.

The intake system N is provided with the downstream intake silencer 60 into which the intake air flows through the outlet air passage 51*o*. The downstream intake silencer 60 has the downstream expansion chamber 61*a*, the vertical inlet air passage 61*i* opening into the upper space 61*a*1 of the downstream expansion chamber 61*a*, and the lateral outlet air passage 61*o* at the level higher than that of the bottom wall 63. The downstream expansion chamber 61*a* has the lower extension 61*a*3 extending downward below the level of the outlet air passage 61*o*. The water-separating rib 68 projects laterally from the position between the lower extension 61*a*3 and the outlet air passage 61*o*. Since the downstream expansion chamber 61*a* has the lower extension 61*a*3 extending downward below the level of the outlet air passage 61*o*, water that flows into the downstream expansion chamber 61*a* together with the intake air flowing down into the downstream expansion chamber 61*a* flows by inertia into the lower extension 61*a*3 and adheres to the bottom wall 63. Thus, water that enters the downstream expansion chamber 61*a* sticks to the bottom wall 63, and the left part 64*b* of the side wall 64 is provided with the water-stopping rib 68. Therefore, water is restrained from flowing into the outlet air passage 61*o*.

The intake system N is provided with the throttle valve device 70 forming the throttle passage 71 connecting to the outlet air passage 61*o*. The inlet air passage 51*i*, the outlet air passage 51*o* and the outlet air passage 61*o* are disposed so as to intersect the straight line La intersecting the inlet air passage 51*i* and the throttle passage 71 as viewed in a plane. The inlet air passage 51*i*, the outlet air passage 51*o*, the inlet air passage 61*i* and the throttle passage 71 are arranged on a straight line as viewed in a plane. Therefore, the flow of the intake air from the inlet air passage 51*i* through the outlet air passage 51*o* and the inlet air passage 61*i* into the throttle passage 71, i.e., the flow of the intake air through the upstream intake silencer 50 and the downstream intake silencer 60, is restrained from meandering in lateral directions, and hence intake resistance is low and volumetric efficiency is high. Consequently, the output performance of the internal combustion engine E is high.

The air-intake opening 41 opens rearward at the rear end of the air-intake space 40. The rib 19 rises from the top wall 6*b* in the air-intake space 40 on the rear, right and left sides of the upstream end 51*i*1 of the inlet air passage 51*i*. Therefore water that enters the air-intake space 40 through a rear part of the air-intake opening 41 is restrained from entering the inlet air passage 51*i* through the upstream end 51*i*1 and is prevented from entering the upstream intake silencer 50.

The air-intake opening 41 is formed so as to surround the upstream intake silencer 50 or the upstream expansion chamber 51 from the right, left and rear sides of the upstream intake silencer 50 or the upstream expansion chamber 51 as viewed in a plane. Therefore, the air-intake opening is long and can be formed in the small width W, so that a necessary intake rate can be ensured and the entrance of foreign matters through the air-intake opening 41 into the air-intake space 40 can be prevented. Moreover, water that enters the air-intake space 40 is drained from the air-intake space 40 in lateral directions and hence water is restrained from flowing through the inlet air passage 51*i* into the upstream intake silencer 50.

Changes that can be made to the foregoing embodiment to provide modifications will be described.

Although the top cover 17 is a part of the upstream intake silencer 50 in the foregoing embodiment, the same part of the upstream intake silencer 50 maybe formed of a separate member. The upstream end 51*o*1 of the outlet air passage 51*o* may open upward.

The rear end of the air-intake space 40 may be closed without forming the air-intake opening 41 in the rear end of the air-intake space 40. When the rear end of the air-intake space 40 is closed, air for combustion is taken into the air-intake space 40 through parts of the air-intake opening 41 longitudinally extending on the right and left sides, respectively, of the inlet pair passage 51*i* and the outlet air passage 51*o*.

The internal combustion engine E is not limited to the four-cylinder internal combustion engine and may be a multiple-cylinder internal combustion engine other than the four-cylinder internal combustion engine or a single-cylinder internal combustion engine.

What is claimed is:

1. An outboard motor comprising:

an internal combustion engine;

an intake system for carrying intake air for combustion into a combustion chamber formed in the internal combustion engine;

an engine cover forming an engine compartment for enclosing the internal combustion engine; and a top cover covering the engine cover from above, wherein the outboard motor includes an air-intake opening formed outside the engine compartment, and an intake silencer for carrying intake air taken in through the air-intake opening into the intake system, the intake system being disposed within the engine compartment;

wherein the intake silencer is disposed outside the engine compartment, is spaced apart from the engine cover such that an air-intake space connecting to the air-intake opening is formed between a top wall of the engine cover and the intake silencer; and the intake silencer has an entrance duct spaced apart from the top wall and having an upstream end through which intake air flows from the air-intake space into the entrance duct, a wall structure defining an expansion chamber into which intake air flows through the inlet air passage, and an exit duct forming an outlet air passage through which intake air flows from the expansion chamber into the intake system;

wherein the inlet air passage has an upstream end opening into the air-intake space, and is on a rear side of a downstream end of the outlet air passage and at a level higher than that of the air-intake opening; and the entrance duct does not extend downward from a bottom wall included in the wall structure defining the expansion chamber and extends upward from the bottom wall in the expansion chamber, wherein the intake system further includes a downstream intake silencer into which intake air flows through the outlet air passage of the exit duct;

the downstream intake silencer has a downstream expansion chamber, a vertically extending inlet air passage opening into an upper part of the downstream expansion chamber, and a horizontally extending outlet air passage formed above a bottom wall forming the downstream expansion chamber;

the downstream expansion chamber has a lower extension extending to a level below that of the outlet air passage; and a horizontal water-stopping rib is disposed between the lower extension and the outlet air passage.

2. The outboard motor according to claim 1, wherein the intake system is provided with a throttle valve device forming a throttle passage connecting to the outlet air passage; and the inlet air passage, the outlet air passage and the outlet air passage are extended so as to intersect a straight line intersecting the inlet air passage and the throttle passage in a plane.

3. The outboard motor according to claim 1, wherein the air-intake opening opens rearward at a rear end of the air-intake space; and a rib is formed on the top wall so as to protrude upward from the top wall in the air-intake space and to extend on right, left and rear sides of the upstream end of the inlet air passage.

4. The outboard motor according to claim 1, wherein the air-intake opening extends on right, left and rear sides of the upstream intake silencer.

5. The outboard motor according to claim 1, wherein the entrance duct includes a side wall extending upward from the bottom wall and surrounding an entire circumference of the upstream end opening.

* * * * *